United States Patent [19]

Nii

[11] Patent Number: 4,630,951

[45] Date of Patent: Dec. 23, 1986

[54] INK RIBBON AND CORRECTION TAPE LIFTING MECHANISM FOR A TYPEWRITER

[75] Inventor: Tomio Nii, Chofu, Japan

[73] Assignee: Tokyo Juki Industrial Co., Ltd., Tokyo, Japan

[21] Appl. No.: 762,510

[22] Filed: Aug. 5, 1985

[51] Int. Cl.[4] ..... B41J 35/22

[52] U.S. Cl. ..... 400/697.1; 400/214; 74/89; 74/435; 74/810; 74/665 F

[58] Field of Search ..... 74/435, 810, 89, 15, 74/665 F; 400/214, 697.1

[56] References Cited

U.S. PATENT DOCUMENTS

| | | | |
|---|---|---|---|
| 933,652 | 9/1909 | Latta | 400/214 |
| 2,886,973 | 5/1959 | Schunemann | 74/435 |
| 3,426,608 | 2/1969 | Loughran et al. | 74/435 |
| 4,065,980 | 1/1978 | Ichinose | 74/435 |
| 4,173,845 | 11/1979 | Heesch | 74/435 |
| 4,511,270 | 4/1985 | Bohmer | 400/214 |

FOREIGN PATENT DOCUMENTS

| | | | |
|---|---|---|---|
| 48011 | 11/1980 | Fed. Rep. of Germany | 400/214 |
| 3234991 | 3/1984 | Fed. Rep. of Germany | 400/214 |
| 9085 | 1/1984 | Japan | 400/214 |

OTHER PUBLICATIONS

Greenlief et al, "Variable Lift . . . Mechanism", IBM Technical Disclosure Bulletin, vol. 26, No. 3B, pp. 1580–1582, 8/83.

*Primary Examiner*—William Pieprz

*Attorney, Agent, or Firm*—Morgan & Finnegan

[57] ABSTRACT

A lifting and lowering mechanism for an ink ribbon and a correction tape of a typewriter includes a stepper motor which drives both a ribbon lift arm and a tape lift arm. First and second gear wheels, partially geared at predetermined portions and pivoted along the stepper motor shaft, engage with a gear wheel equipped at the ribbon lift arm and the tape lift arm respectively. The ink ribbon and the correction tape are lifted separately and selectively by changing the direction of the stepper motor rotation.

7 Claims, 7 Drawing Figures

Prior Art

INK RIBBON AND CORRECTION TAPE LIFTING MECHANISM FOR A TYPEWRITER

BACKGROUND OF THE INVENTION

The invention pertains to a lifting mechanisms for typewriter ink ribbons and correction tapes. More particularly, the invention pertains to a system for raising and lowering separate typewriter ink ribbons and correction tapes.

Generally, two types of ink ribbons are used for typewriters. One is a multi-strike fabric ribbon and the other is a one-time or one-strike ribbon.

The ink-hydrous type of fabric ribbon is formed on a ring and is arranged to be struck repeatedly at substantially the same spot. However, due to its fabric construction, the printing quality of the fabric ribbon is generally not high.

On the other hand, a one-time or one-strike ribbon which is generally made of plastic, is arranged not to be struck at the same spot again because, otherwise, plastic film at the tape surface would be scaled-off. Therefore, the feeding pitch of the one-time or one-strike ribbon is desirably arranged to be as short as possible yet non-overlapping.

Referring to FIG. 2 and FIG. 3, the width d of the illustrated ribbons are sized four to five times the size of the print character. As the ribbons are fed in the direction of the arrows, the ribbon is simultaneously lifted and lowered per each printing action. Accordingly, since the striking position moves up and down, overlapped printing is avoided although the feeding pitch may be very small.

The use of overlap avoidance for a single strike ribbon is explained by way of reference to FIG. 2. For instance, when "A" is to be printed, it is printed in order of $P_1$-$P_2$-$P_3$-$P_4$ . . . . Overlapped printing is avoided as the striking position moves up and down.

The use of overlap avoidance for a multi-strike ribbon is explained by way of reference to FIG. 3. The feeding pitch illustrated in FIG. 3 is smaller than the pitch of FIG. 2 and the characters are printed in the order of $P_1$-$P_2$-$P_3$-$P_4$-$P_5$ . . . . In this example, although the striking position moves up and down, printing is also slightly overlapped, as the figure shows.

Accordingly, multi-strike ribbons generally have a longer useful life, but their printing quality is generally lower than the single-strike ribbons.

The above described ribbons are used for printing. Additionally, many typewriters provide for the use of a correction tape which corrects misprinted characters. In such systems, it is necessary to arrange lifting methods for both the ink-ribbon and the correction tape.

FIG. 1 shows an example of a prior known ribbon lifting apparatus. Referring to FIG. 1, item 1 denotes a driving shaft of a stepper motor $M_1$. Item 2 denotes a pair of ribbon lift arms fixed to the driving shaft 1. The extended end portions of ribbon lift arms 2 include ribbon guides 2*a* which hold and direct an ink ribbon 3.

Item 4 represents a solenoid which lifts and lowers a link 5. Through the motion of the link 5, a pair of correction tape lift arms 6 are rotated around a fixed shaft 7 and thus the correction tape 8, held by the tape guides 6*a*, may be lifted or lowered. The fixed shaft 7 is fixed to typewriter body which is not shown in FIG. 1.

Under the above described lifting construction, printing is performed in the up and down order of $P_1$-$P_2$-$P_3$ . . . (see FIGS. 2 and 3).

During printing using the known apparatus according to FIG. 1, the ribbon lift arm 6 is generally arranged to resume its original print position after each printing action. An exception to this is provided in certain typewriters wherein a printing REPEAT function is allowed.

During correction operation, on the other hand, the solenoid 4 lifts up the tape lift arm 6 through the link 5 whereby the correction tape 8 is oriented in the correct position to be struck.

In the above described known lifting mechanism (FIG. 1), the printing ribbon 3 is lifted by the stepper motor M, and the correction tape is lifted by the solenoid 4. Thus, two drivers are needed to perform the lifting functions. Such plural mechanisms result in higher cost and weight factors. Further, such mechanisms require accurately and minutely stepped stepper motors to effectively use multi-strike ribbons; such stepper motors are expensive and of a bulky size.

It is therefore an object of the invention to provide an effective and efficient print ribbon and correction tape lifting mechanism.

It is a further object of the invention to provide a print ribbon and correction tape lifting mechanism which is low in cost while being effective for both single strike and multi-strike ribbon applications.

SUMMARY OF THE INVENTION

These and other objects of the invention are met by providing a print ribbon and correction tape lifting mechanism which comprises a large gear wheel and a small gear wheel, whose circumferential geared portions are limited to predetermined portions, the gear wheels being fixed to a drive shaft of a single stepper motor. A print ribbon lift arm includes internal gears to engage with the large gear wheel and a correction tape lift arm includes gears to engage with the small gear wheel. Since only one stepper motor is required with the invention, production costs are reduced and the total configuration requires less space. Further, since the lifting range of the ribbon lift arm is defined by gearing action, it is possible to adjust lifting range minutely for use with a multi-strike ribbon by using a miniature "track-lift".

BRIEF DESCRIPTION OF THE DRAWINGS

The invention will be described more fully below by way of reference to the following drawings, in which.

DETAILED DESCRIPTION OF THE DRAWINGS

FIGS. 4, 5, 6A and 6B illustrate one embodiment of the present invention. Referring to drawings, item $M_2$ denotes a stepper motor fixed to, for example, a typewriter body (not shown). Item 11 denotes the drive shaft of the stepper motor $M_2$. As illustrated, the invention includes two gear wheels, a large gear wheel 12 and a small gear wheel 13, spaced slightly apart from each other on the drive shaft 11.

Figure 5:
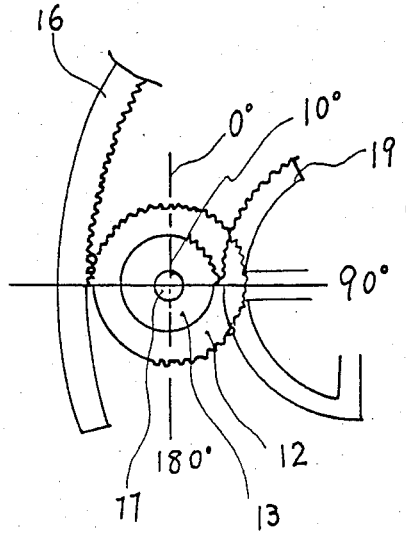
FIG. 5 is an elevation of a small gear wheel and a large gear wheel taken along axial direction of a motor shaft of an apparatus according to the invention.

Referring to FIG. 5, which is a side view drawing, the large gear wheel 12 is shown geared in the counterclockwise direction at its circumference from 0° to −90° and is geared in the clockwise direction at its circumference from 0° to 190°. The small gear wheel 13 is geared in the clockwise direction at its circumference from 10° to 90°.

Figure 4:
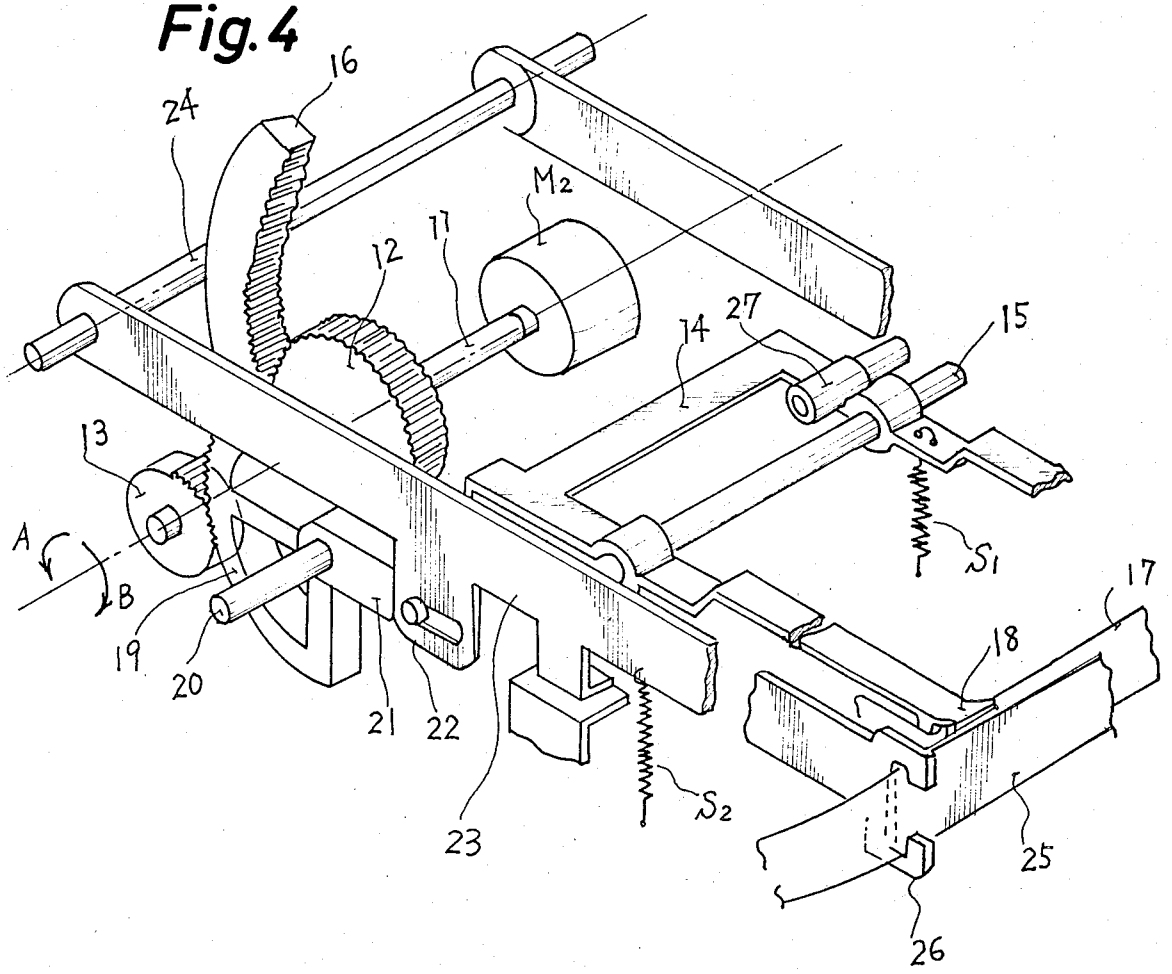
FIG. 4 is a perspective view of a mechanism for lifting an ink ribbon and a correction tape according to the instant invention.

A ribbon lift arm 14 is provided which rotates around a fixed shaft 15 (FIG. 4). Item 16 denotes an internal gear wheel formed as an extended portion of the ribbon lift arm 14 (see FIGS. 4 and 6B). Gears are formed circumferentially within the internal gear wheel portion 16 keeping the shaft 15 which passes through lifter retainers 16*a* as a center thereof.

A spring $S_1$, urges the ribbon lift arm 14 to be pulled down. The other end of the spring $S_1$ may be connected to the typewriter (not shown). A stopper 27 may be provided to define the movement range of the ribbon lift arm 14. At the extended end of the ribbon lift arm 14, a ribbon guide 18 is provided which holds an ink-ribbon 17.

Figure 6A:
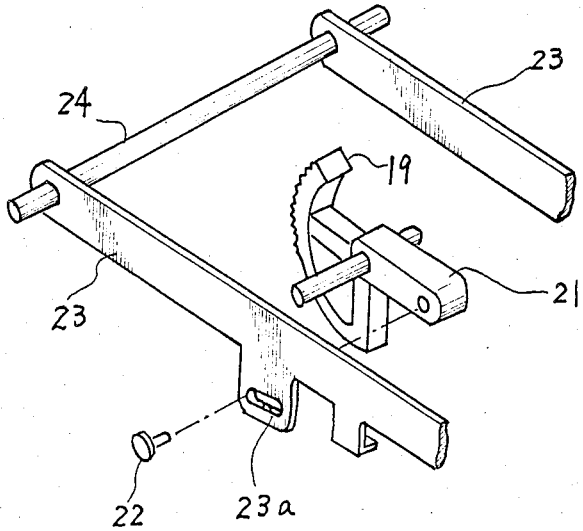
FIG. 6A is a perspective and partially exploded view of a tape lift arm of an apparatus according to the invention.
Figure 6B:
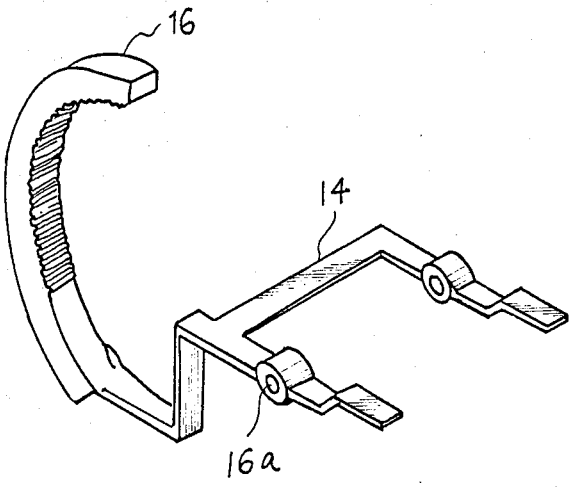
FIG. 6B is a perspective and partially exploded view of a correction tape lifting arm of an apparatus according to the invention.

Item 19 (FIGS. 4, 5 and 6A) denotes a gear wheel portion formed as a portion of the correction tape lift arm 21 which rotates around a pivoted fixed shaft 20. A pin 22 slideably engages an oblong hole 23*a* provided within a tape plate 23 (FIG. 6A). As the tape arm 21 rotates, the pin 22 acts to rotate the tape plate 23 around a provided fixed shaft 24. At the forward end portion of the tape plate 23, a tape guide 26 is provided which holds a correction tape 25.

$S_2$ (FIG. 4) denotes a spring which urges the tape plate 23 to be pulled down. The opposite end of the spring $S_2$ may be connected to the typewriter (not shown).

The operation of the embodiment of the invention illustrated in FIGS. 4, 5, 6A and 6B will now be explained.

Referring to FIG. 4 and FIG. 5, during off time (i.e., no typing, no correction), the ribbon lift arm 14 and the tape lift arm 21 remain in the un-lifted condition illustrated in FIG. 4. Such a condition will be referred to as the HOME POSITION. At the HOME POSITION, the gear wheels 12, 13 are in their "ready" positions illustrated in FIG. 5.

When the stepper motor $M_2$ rotates and its shaft 11 turns in the direction of arrow A (FIG. 4) to lift the ribbon, the large gear wheel 12 and the inner gear wheel 16 are engaged and the ribbon lift arm 14 rotates around the fixed shaft 15. In this case, the small gear wheel 13 rotates in response to the rotation of stepper motor $M_2$ in the same direction A as the large gear wheel 12. Thereby, the small gear wheel 13 does not engage with the gear portion 19 (see FIG. 5) and, accordingly, the tape lift arm 21 does not rotate.

Figure 1:
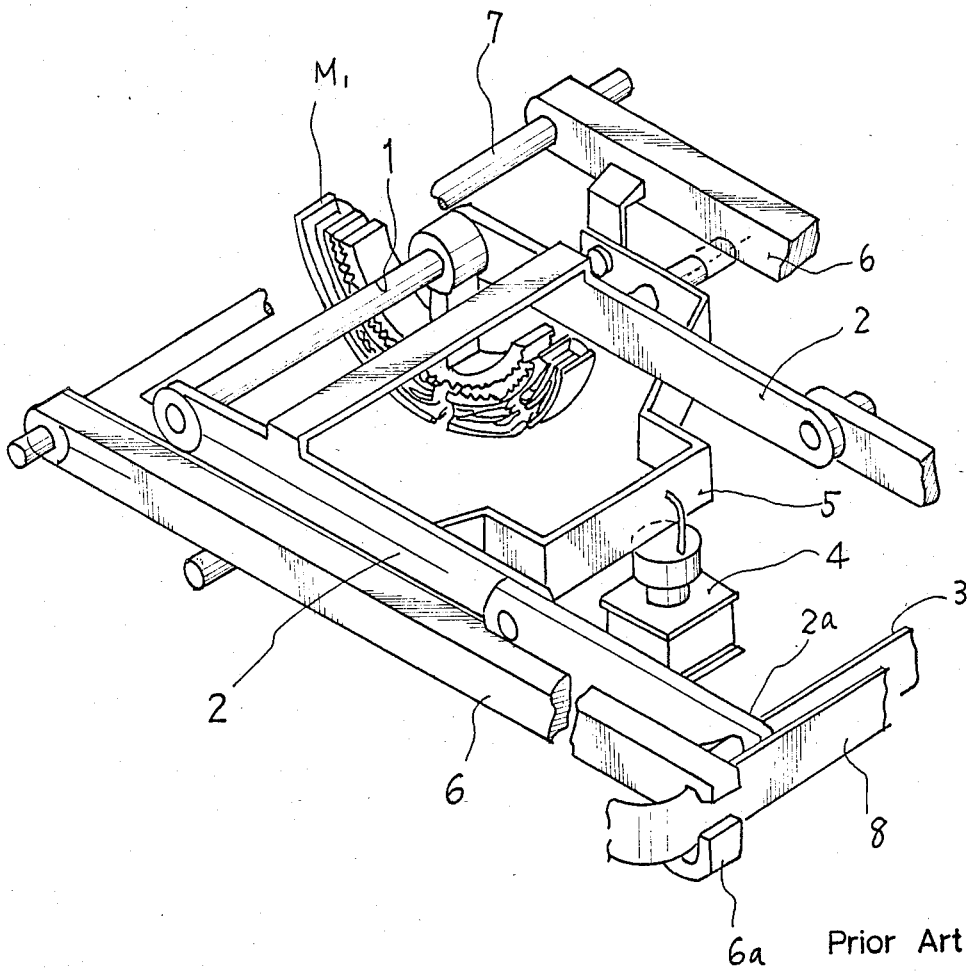
FIG. 1 is a perspective view of a known mechanism for lifting an ink ribbon and a correction tape.
Figure 2:
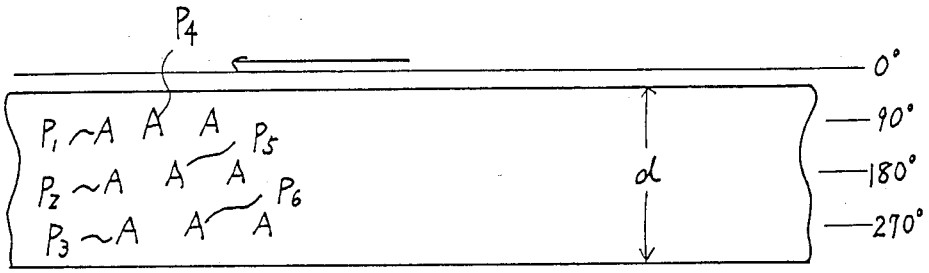
Fig. 2 Prior Art
FIG. 2 illustrates a printing method for a single-strike ribbon.

When a single-strike ribbon is being used (see FIG. 2), the large gear wheel 12 may be made to rotate 90 degrees in the direction of arrow A (FIG. 4). When a printing line is finished, the large gear 12 resumes its 0° position. As a next step, the large gear wheel 12 rotates 180 degrees. When the printing P line is finished, the large gear wheel resumes its 0° position. While repeating the above printing action, as FIG. 2 illustrates, the ribbon is also fed in the direction of the arrow with a small constant pitch.

Figure 3:
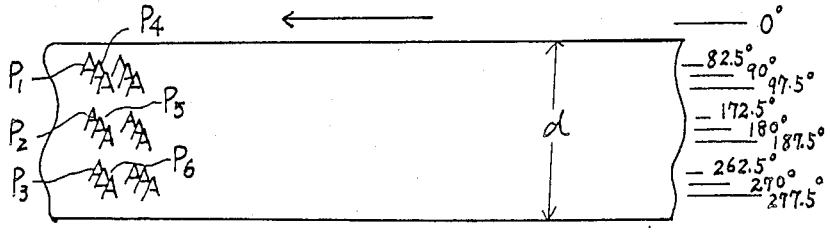
Fig. 3 Prior Art
FIG. 3 illustrates a printing method for a multi-strike ribbon.

When the multi-strike ribbon is used (see FIG. 3), the large gear wheel 12 may be set to rotate in the direction of arrow A (FIG. 4) in rotation angle steps of 0°-82.5°-0°-172.5°-0-262.5°-0° and thus printing performs in the order of $P_1$-$P_2$-$P_3$ (FIG. 3). Likewise, the large gear wheel 12 may be made to rotate in steps of 0°-90°-0-180°-0°-270° and, thus printing performs in the order of $P_4$-$P_5$-$P_6$. Large gear wheel 12 further continuously rotates steppingly 0°-97.5°-0°-187.5°-0°-277.5° and simultaneously printing performs in order of $P_7$-$P_8$-$P_9$. During the above described printing performance, the multi-strike ribbon is fed with a smaller pitch compared to the single strike ribbon feed of FIG. 2.

When the correction tape 25 (FIG. 4) is to be lifted for correction work, the driving motor shaft 11 is rotated in the direction of arrow B. Thus, the small gear wheel 13 engages with the gear wheel portion 19 of the correction tape lift arm, and consequently the tape lift arm 21 is lifted. The pin 22 secured to the tape lift arm 21 slides along the oblong hole 23*a* causing the tape plate 23 to be lifted, countering the downward pulling force of spring $S_2$. Thus the correction tape 25, held in the tape guide 26, is lifted to the proper position for correction work to be done.

In this case, the lifting distance is defined by the rotation angle of the small gear wheel which, in this example, is 80 degrees. During the correction work, the large gear wheel 12 does not engage with the internal gear wheel 16 since the shaft 11 rotates in the direction of arrow B (see FIG. 4) and since there are no corresponding gears at that portion of the gear wheel 16.

As mentioned above, according to the invention both the large gear wheel and the small gear wheel are fixed to the shaft of the prime stepper motor and are geared circumferentially at predetermined portions only. The ribbon lift arm includes an internal gear wheel. The internal gear wheel engages with the large gear wheel as necessary. The tape lift arm also provides a gear wheel which engages with the small gear wheel as necessary. Since only one prime stepper motor is required in invention, production costs are reduced and the total configuration requires less space. Further, since the lifting range of the ribbon lift arm is defined by gearing action, it is possible to adjust lifting range minutely by providing a miniature "track-lift" function for use with a multi-strike ribbon.

As many apparently widely different embodiments of this invention may be made without departing from the spirit and the scope thereof, it is to be understood that the invention is not limited to the specific embodiments herein disclosed except as defined in the appended claims.

I claim:

1. A lifting mechanism for lifting ink ribbon and correction tape for a typewriter, comprising: a large gear wheel and a small gear wheel which are fixed to a driving motor shaft and which provide gear teeth at predetermined portions of the circumferences of the respective gear wheels, a ribbon lift arm including a gear wheel portion integrally connected thereto and an extended portion for supporting and lifting said ink ribbon, and providing a pivot point between said gear wheel portion and said extended portion, said gear wheel portion being arranged to engage at the time of lifting with the gear teeth of said large wheel, said ribbon lift arm pivoting about said pivot point at the time of lifting, and further comprising a tape lift arm including a gear wheel portion integrally connected thereto which is arranged to engage at the time of lifting with the gear teeth of said small gear wheel, a tape lift plate for supporting and lifting said correction tape and a direct connection between said tape lift arm and said tape lift plate whereby rotary motion imparted to said tape lift arm is transmitted as lifting motion to said tape lift plate, said tape lift arm rotating about a pivot point located between its gear wheel portion and an opposite end thereof whereat said tape lift plate is connected.

2. A lifting mechanism, as recited in claim 1, wherein rotating said shaft in a first direction causes said ink ribbon to lift and wherein rotating said shaft in a second direction opposite said first causes said correction tape to lift.

3. A lifting mechanism, as recited in claim 3, wherein said large gear wheel is geared substantially 280° about its circumference and wherein said small gear wheel is geared substantially 80° about its circumference.

4. A lifting mechanism, as recited in claim 1, wherein said ribbon lift arm gear wheel portion includes internal gears for engagement with said large wheel.

5. A lifting mechanism, as recited in claim 1, wherein said tape lift arm gear wheel portion includes external gears for engagement with said small wheel.

6. A lifting mechanism, as recited in claim 3, wherein said ribbon lift arm gear wheel portion includes internal gears for engagement with said large wheel.

7. A lifting mechanism, as recited as claim 3, wherein said tape lift arm gear wheel portion includes external gears for engagement with said small wheel.

* * * * *